US005275555A

United States Patent [19]

Goodridge

[11] Patent Number: 5,275,555

[45] Date of Patent: Jan. 4, 1994

[54] HOLDING AND COVERING A GAS PILOT

[76] Inventor: Mark S. Goodridge, 12831 8th Ave. S., Sea, Wash. 98168

[21] Appl. No.: 931,034

[22] Filed: Aug. 14, 1992

[51] Int. Cl.[5] ..... F23D 11/36

[52] U.S. Cl. ..... 431/343; 431/258; 431/285; 126/41 R; 126/39 E

[58] Field of Search ..... 431/343, 258, 285; 126/41R; 39E

[56] References Cited

U.S. PATENT DOCUMENTS

| | | | |
|---|---|---|---|
| 1,678,130 | 7/1928 | Tyler . | |
| 1,690,223 | 11/1928 | Fonseca . | |
| 1,952,550 | 3/1934 | Kerr | 158/117.1 |
| 2,520,299 | 8/1950 | Antrim | 158/117.1 |
| 2,648,377 | 8/1953 | Bodey | 158/115 |
| 2,896,704 | 7/1959 | Aleweld | 158/115 |
| 3,202,202 | 8/1965 | Kuhn et al. | 431/285 |
| 3,260,300 | 7/1966 | Lannert et al. | 158/116 |
| 3,308,871 | 3/1967 | Riehl | 158/143 |
| 3,762,639 | 10/1973 | Katchka et al. | 431/285 X |
| 3,814,077 | 6/1974 | Riehl | 126/39 E |
| 3,846,064 | 11/1974 | Katchka | 431/285 |
| 3,870,458 | 3/1975 | Hendrick | 431/285 X |
| 4,941,817 | 7/1990 | Schlosser | 431/263 |
| 4,943,232 | 7/1990 | Lin | 431/263 |

*Primary Examiner*—Larry Jones

*Attorney, Agent, or Firm*—William R. Bachand

[57] ABSTRACT

A device for holding and covering a gas pilot used to ignite a gas burner includes a rigid bracket for holding the pilot and a rigid cover over the pilot. The bracket includes a bifurcated plate that grips the pilot and holds it in fixed relation to the gas burner. The cover extends over the pilot to protect it from being misaligned by heavy objects and from being extinguished by drafts and by materials heated over the burner. The device increases the reliability of the gas burner.

20 Claims, 2 Drawing Sheets

HOLDING AND COVERING A GAS PILOT

BACKGROUND OF THE INVENTION

This invention relates to a shield for an ignition device, particularly a shield for a gas pilot used to ignite a gas burner. Use of the shield extends the useful life of the pilot and reduces gas stove maintenance.

Gas burners, especially on cook stoves, are used intermittently. The supply of gas to such a burner can be completely shut off by the operator to extinguish the burner. When a pilot flame is located near the burner, reapplication of the supply of gas to the burner is sufficient to reignite the burner. Thus, intermittent operation of the burner is made possible by directing a continuously lit pilot jet toward the burner. When the pilot is misaligned or extinguished, intermittent operation of the burner is not possible and there is an increased risk of unexpected combustion and explosion. Accidental misalignment and extinguishment of the pilot can arise in several ways.

Accidental misalignment of the pilot in relation to the burner occurs when the operator carelessly allows a heavy object to strike the pilot. For example, if the burner is used for heating materials in a vessel, the pilot can be misaligned, damaged, or extinguished when the vessel comes in contact with the pilot. The vessel is usually separated from the burner by a grate so that the vessel is heated by a cushion of air rather than by the flames from the burner. The pilot can be misaligned, damaged, or extinguished when the grate is allowed to strike the pilot. Proper cleaning of commercial cook stoves often requires the frequent removal and replacement of the grate, consequently increasing the risk of harmful contact between the grate and the pilot.

Accidental extinguishment of the pilot can occur suddenly or over the course of time. Sudden changes in the air flowing around the pilot can extinguish the pilot. For example, when an exhaust hood which is operated over the burner is turned on or off, the sudden change in air flow can extinguish the pilot. When materials that spatter are heated over the burner, the spattered particles and droplets can enter the orifices of the pilot and suddenly extinguish the pilot, or burn and leave deposits that eventually foul an orifice, rendering the pilot inefficient or unable to ignite the burner. During maintenance of the burner, cleaning solutions can enter an orifice in the pilot and later form deposits within the pilot that obstruct and extinguish it. Removal of deposits is often more difficult than replacement of the pilot and its gas feeder tube. Replacement of the pilot necessarily interrupts commercial use of the burner and is costly in labor and materials.

Operation of the pilot near the burner can interfere with use of the burner to provide even heating. Because the pilot flame is directed toward the burner for ignition, the heat of the flame can create a hot spot on the vessel located over the burner. Undesirable uneven heating of the vessel and its contents results.

Covers for pilot jets have been disclosed in the prior art. Typical of such devices are those wherein the cover is used to sense heat or to conduct heat to a sensing device. The sensing device usually acts to shut off the supply of gas to the pilot and the burner to prevent gas from escaping from an extinguished pilot or burner. In this art, the size and orientation of the cover is not sufficient to protect the pilot from being extinguished.

Another implementation of a pilot igniter and gas burner in the prior art is adapted for use as an oven burner in a gas cooking range. The typical implementation uses a constant first pilot from a range top burner in communication with a flash tube to ignite a second pilot near the oven burner supplied with gas only when the oven burner is to be used. A sudden change in air flow caused by opening or closing the oven door may extinguish the second pilot which is then relit by the first pilot via the flash tube. In such an implementation, the second pilot is not protected from being extinguished by draft or obstruction.

To help prevent extinguishment of a pilot due to drafts, including the draft caused by the sudden ignition of a burner, pilots have been disclosed wherein an orifice in the pilot is formed as a slot rather than as a circular hole. Such a pilot typically consumes more fuel than a pilot having a circular orifice. In one implementation, the fuel supply to the pilot is maintained at a low standby level until ignition of the burner is desired, whereupon the gas supply to the slotted pilot is increased prior to supplying gas to the burner. In many applications, a slotted pilot would consume fuel at a cost that outweighs the convenience and simplicity of a continuous standing pilot.

In place of a continuous pilot, an electrostatic igniter has been used to ignite a gas burner for a gas barbecue grill. In the typical arrangement, a high voltage cable is terminated in the vicinity of a ground conductor so that a spark between the termination and the conductor ignites gas escaping from the burner. Operation of the igniter depends upon maintaining proper position of the igniter in relation to the burner and also upon maintaining the cleanliness of the termination and conductor in spite of grease drippings and other deposits incident to barbecuing. In one implementation, an igniter enclosure includes means to hold the high voltage wire within the enclosure and in juxtaposition to one wall of the enclosure. The wall of the enclosure serves as the ground conductor. In another implementation, a similar igniter enclosure is shown with adjustable means for maintaining the position of the housing in relation to the burner. Such implementations do not provide the structural integrity required for a commercial cook stove or the like. And, although the termination and one wall of the enclosure are protected from deposits that interfere with ignition, deposits can collect within the igniter enclosure on surfaces that are not accessible for cleaning to meet standards for cleanliness that apply to commercial cook stoves and the like.

Thus, there remains a need for a simple device that protects a gas pilot igniter in a manner suitable for use on commercial cook stoves and the like.

SUMMARY OF THE INVENTION

Accordingly, one object of the invention is to improve the reliability of gas burners that are used intermittently.

Another object of the invention is to protect a gas pilot from being damaged or dislodged from its optimal position, alignment, and orientation in relation to a burner that the pilot is used to ignite.

Another object of the invention is to maintain proper alignment of a pilot in relation to a gas burner for efficient ignition of the burner.

Another object of the invention is to protect the pilot in a manner which does not interfere with cleaning practices ordinarily associated with commercial gas cook stoves.

Another object of the invention is to reduce the possibility of extinguishing the pilot due to operation of an exhaust hood over the pilot.

Another object of the invention is to provide a shield for a gas pilot so that the pilot is not fouled by deposits on and within the pilot.

Yet another object of the invention is to reduce pilot maintenance and to avoid costly interruption of use of a burner due to failure of the pilot used to ignite the burner.

Still another object of the invention is to provide a device for protecting the pilot that can be added easily to existing cook stoves.

Additional objects, advantages, and other novel features of the invention will be set forth in part in the description that follows and in part will become apparent to those skilled in the art upon examination of the following or may be learned with the practice of the invention. The objects and advantages of the invention may be realized and attained by means of the instrumentalities and combinations particularly pointed out in the appended claims.

To achieve the foregoing and other objectives, and in accordance with the purposes of the present invention, a device of this invention combines in one rigid assembly a cover for mounting over a gas pilot and a bracket for holding the pilot in proper position, orientation, and alignment under the cover. The cover and the bracket are formed to block the flow of air across the pilot.

The cover includes a top plate that intersects the predominant trajectories of spattered particles that otherwise would contact the pilot or burn so as to leave deposits on or within the pilot. The top plate is held rigidly in place by a support that permanently maintains the position and orientation of the top plate in order to deflect objects which could otherwise render mechanical damage to the cover or the pilot.

Other aspects of the invention will become apparent in the following detailed description of the preferred embodiment of this invention made with reference to the accompanying drawings.

DETAILED DESCRIPTION OF SPECIFIC EMBODIMENTS

Figure 1:
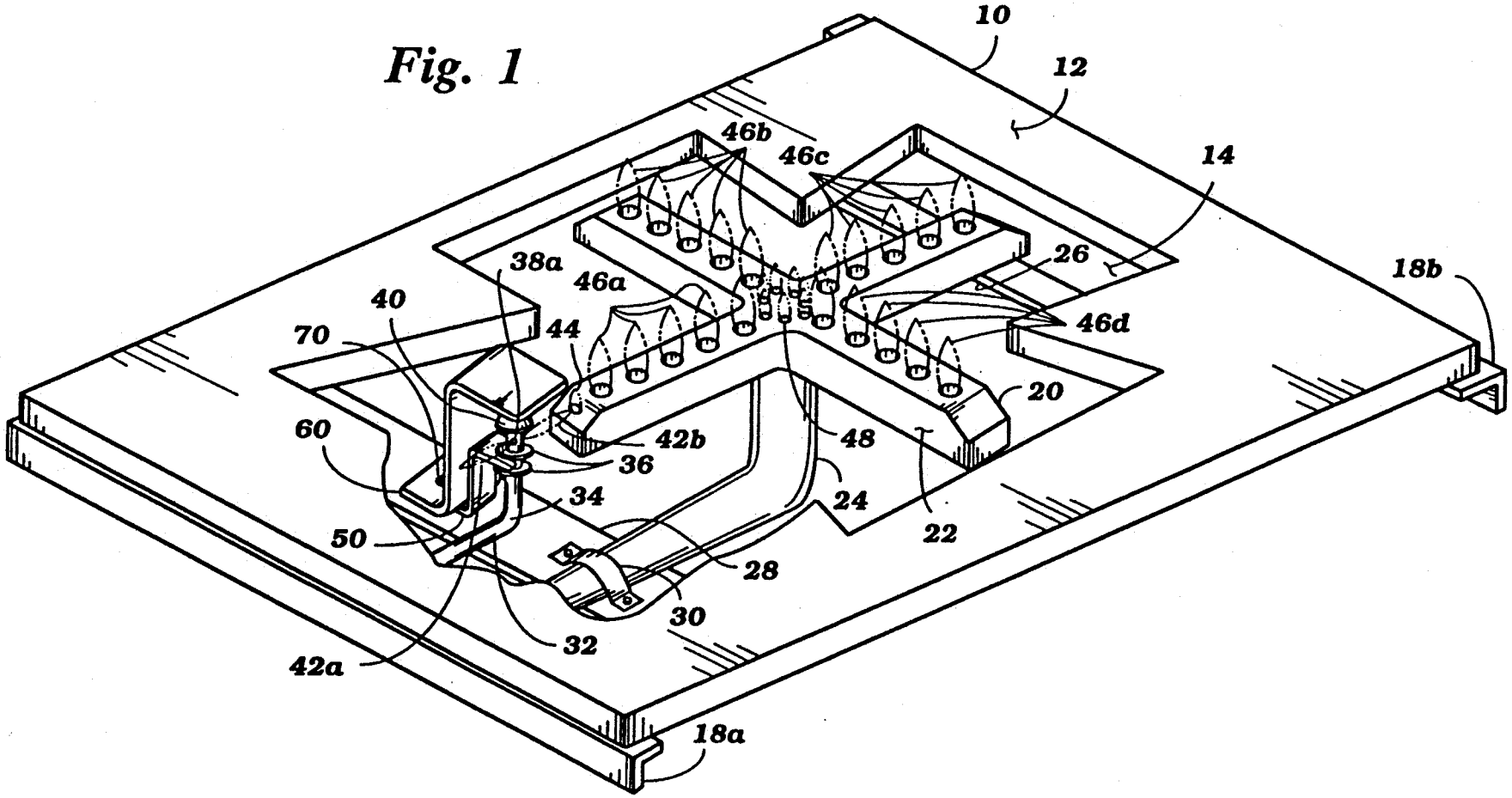
FIG. 1 is a perspective view of an improved gas stove having a gas burner and pilot held and protected according to the present invention.

Referring to FIG. 1, an improved gas stove 10 of the present invention has a grate 12 with an opening 14, the grate 12 supported over a burner 20 by supports 18*a* and 18*b*. The burner 20 has a perforated chamber 22 removably connected to a venturi 24 and is supported by a bar 26 under the perforated chamber 22 and a bar 28 and clamp 30 under the venturi 24. A gas pilot 32 is located near the perforated chamber 22. The pilot 32 has a pilot tube 34, a pair of rings 36, orifices 38*a* and 38*b*, and a cap 40. A bracket 50 grasps the pilot 32 between the rings 36. The bracket 50 and a cover 60 are securely fastened to the bar 28 by a screw 70. Any other appropriate means of fastening may be used including riveting, crimping, welding, or the like, and forming a portion of the structure of the stove into functionally equivalent bracket and cover structures. The design and function of the bracket 50 and cover 60 can be better understood following a description of the operation of the burner 20 and the location of the pilot 32.

To operate the improved gas stove of FIG. 1, gas is continuously supplied through the pilot tube 34. The operator ignites a pilot flame 42*a* or 42*b* using a match or the like. When the operator desires to begin use of burner 20, the operator supplies gas to burner 20 through venturi 24. The gas escapes from ignition orifice 44, from main orifices 46*a* through 46*d*, and from the ring of orifices 48. The pilot flame 42*b* ignites the gas escaping from ignition orifice 44, which in turn ignites main orifices 46*a*, which in turn ignites the ring of orifices 48, which in turn ignite the remaining main orifices 46*b* through 46*d*. Successful ignition of burner 20 depends upon proper location of pilot 32 in proximity to ignition orifice 44. The positional relationship between pilot 32, grate 12, and perforated chamber 22 is shown more clearly in FIG. 2.

Figure 2:
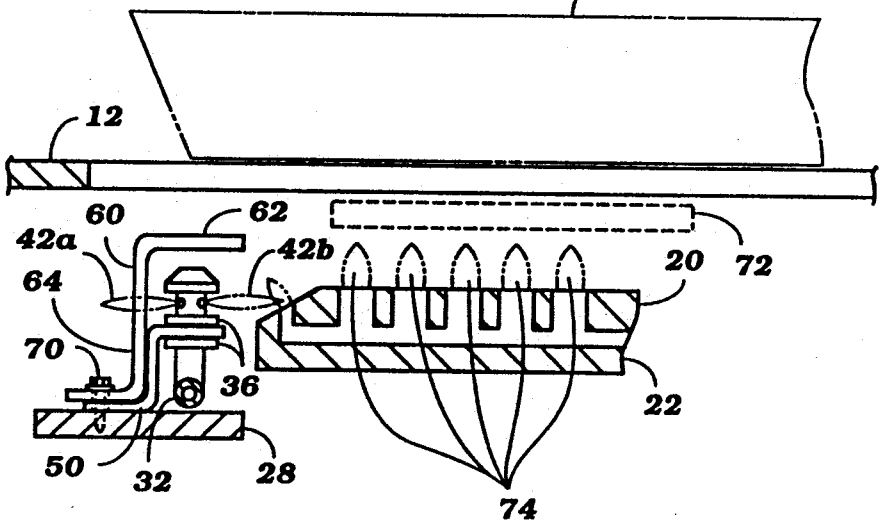
FIG. 2 is a partial side cut-away view of another improved gas stove having a gas burner and pilot held and protected according to the present invention.

FIG. 2 is a partial side cut-away view of another improved gas stove having a gas burner and pilot held and protected according to the present invention. In FIG. 2, a pan 80 is supported by portions of grate 12 which do not appear in this view. When burner 20 is lit, grate 12 holds pan 80 above a cushion of air 72 that is heated by flames 74. The distance between grate 12 and perforated chamber 22 is customarily between 1 and 1.5 inches and is selected by the designer of the stove in light of the importance of even heating, the available gas pressure, and the desired range of heating temperatures, as well as factors including structural strength of the burner and grate, and cleanliness requirements.

The distance between pilot 32 and perforated chamber 22 is customarily less than 1 inch so that gas consumption by pilot 32 can be minimal for economy, heat generated by pilot 32 can be minimal so as not to create a hot spot on pan 80, and ignition of the gas from ignition orifice 44 is prompt and certain. The distance from ignition orifice 44 to pilot 32 is maintained by bracket 50 which grasps pilot 32 between the pair of rings 36. Bracket 50 is rigidly mounted to bar 28 by screw 70.

As can be seen in FIG. 2, cover 60 has a top plate 62 connected to support 64 connected to cover base 66. Cover base 66 is rigidly mounted to bar 28 by screw 70. Top plate 62 is spaced above cap 40 and below grate 12. Top plate 62 is large enough and oriented in a position to intersect the predominant trajectories of spilled or spattered materials emanating from pan 80. By locating top plate 62 or support 64 in close proximity to pilot flames 42*a* or 42*b*, all surfaces of cover 60 and bracket 50 can maintain a temperature high enough to burn off any residue of spilled and spattered materials emanating from pan 80. Top plate 62 and support 64 are large enough to block the flow of air on two sides of pilot 32, protecting pilot flames 42*a* and 42*b* from being extinguished by sudden changes in air flow.

A device of this invention must be constructed of rigid material, such as stainless steel, for operation near a pilot flame. Rigidity prevents relocation of the top plate 62 and bracket 50. Rigidity also prevents mechanical damage to the pilot. In practice, vessels, utensils, and portions of the stove removed for cleaning often strike pilot 32 and pilot tube 34 causing damage and loss of efficient operation, placement, and orientation of pilot 32. Three examples of a device for holding and covering a gas pilot according to the present invention are illustrated in FIGS. 3, 4, and 5.

Figure 3:
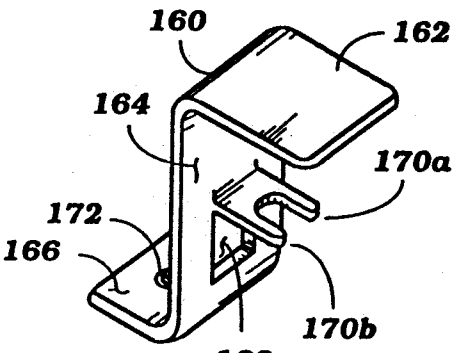
FIG. 3 is a perspective view of a device for holding and protecting a gas pilot according to the present invention.

In FIG. 3, cover 160 is shown having top plate 162, support 164, and cover base 166. A portion of support 164 is extended upward and away from support 164 toward the underside of top plate 162 leaving opening 168. When installed in place of bracket 50 and cover 60 in FIGS. 1 and 2, bifurcations 170*a* and 170*b* grasp pilot 32 between the pair of rings 36. Screw 70, passing through hole 172, rigidly fastens cover base 166 to bar 28 or a similar structure near pilot 32. Pilot tube 34 partially obstructs opening 168 so that pilot flames 42*a* and 42*b* are protected from being extinguished by sudden changes in air flow. FIG. 3 illustrates a one piece configuration, possibly producible at lower cost than the configurations shown in FIGS. 4 and 5.

Figure 4:
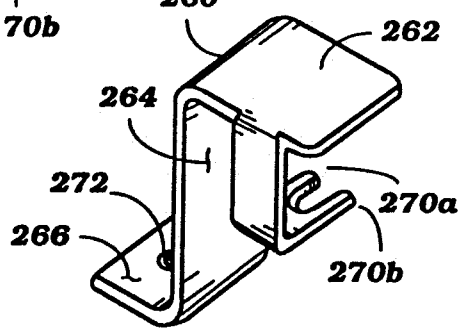
FIG. 4 is a perspective view of another device for holding and protecting a gas pilot according to the present invention.

In FIG. 4, cover 260 is shown having top plate 262, support 264, and cover base 266. A portion of top plate 262 is extended downward and then under top plate 262. When installed in place of bracket 50 and cover 60 in FIGS. 1 and 2, bifurcations 270*a* and 270*b* grasp pilot 32 between the pair of rings 36. Screw 70, passing through hole 272, rigidly fastens cover base 266 to bar 28 or a similar structure near pilot 32. By reversing all of the folds shown in FIG. 4, an equivalent device can be constructed for applications where the pair of rings 36 must be grasped from an opposite direction. The configuration shown in FIG. 4 is superior to configurations shown in FIGS. 3 and 5 in the protection given pilot 32 from being extinguished by sudden changes in air flow. Using the device of FIG. 4, air flow near pilot 32 is blocked on three sides.

Figure 5:
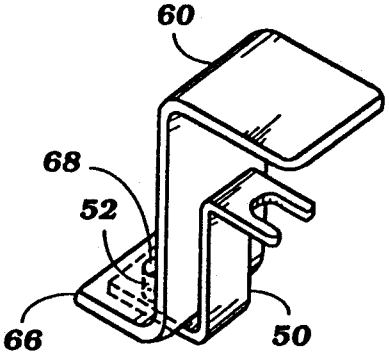
FIG. 5 is a perspective view of another device for holding and protecting a gas pilot according to the present invention.

In FIG. 5, cover 60 is shown over bracket 50. Hole 68 in cover base 66 is aligned over a corresponding hole 52 in bracket 50. When installed as shown in FIGS. 1 and 2, screw 70 passes through holes 52 and 68 to rigidly fasten cover base 66 and bracket 50 to bar 28 or a similar structure near pilot 32. The configuration shown in FIG. 5 provides greater mechanical protection to the pilot 32 than the configurations shown in FIGS. 3 and 4 because cover support 64 is reinforced by direct contact with bracket 50.

While the problems solved by this invention have been shown on a simplified stove and described in connection with commercial cooking, and while the invention has been described in what is considered to be the most practical and preferred embodiment, it is understood that the invention is not limited to the disclosed embodiments, but is intended to cover various arrangements included within the spirit and scope of the broadest interpretation so as to encompass all such modifications and equivalent arrangements.

What is claimed is:

1. A device for holding a gas supply having an orifice for issuing an ignition flame, the device shielding the orifice, the device comprising:

a. a base;

b. a cover attached rigidly to the base; and c. positioning means coupled to the base for holding the supply in a position so that the cover shields the orifice and covers a region around the orifice, and for directing the flow of gas from the orifice.

2. The device of claim 1 further comprising means for collectively mounting the base and the positioning means.

3. The device of claim 1 further characterized by being formed as a unit.

4. A device for holding and covering a pilot for igniting a gas burner, the pilot comprising a tube having an open end for gas to enter the tube and a closed end; a pair of rings encircling the tube and attached to the tube near the closed end of the tube; and an orifice in the tube located between the closed end of the tube and the pair of rings, the orifice for directing a jet of gas radially away from the tube and toward the burner to ignite the burner; the device comprising:

a. a bracket having a bracket base mounted in fixed relation to the gas burner; and a bifurcated plate attached to the bracket base, the bifurcations formed to grip the pilot between the pair of rings on the pilot; and b. a cover located over the pilot, the cover having a cover base attached to the bracket; and a rigid top plate attached to the cover base.

5. A device for holding and covering a pilot for igniting a gas burner, the pilot comprising a tube having an open end for gas to enter the tube and a closed end; a pair of rings encircling the tube and attached to the tube near the closed end of the tube; and an orifice in the tube located between the closed end of the tube and the pair of rings, the orifice for directing a jet of gas radially away from the tube and toward the burner to ignite the burner; the device comprising:

a. a base mounted in fixed relation to the gas burner;

b. a rigid first support plate attached to the base;

c. a rigid cover plate attached to the first support plate, the cover plate extending over the pilot; and d. a bifurcated plate attached to the cover plate, the bifurcations formed to grip the pilot between the pair of rings on the pilot.

6. A device for holding and covering a pilot for igniting a gas burner, the pilot comprising a tube having an open end for gas to enter the tube and a closed end; a pair of rings encircling the tube and attached to the tube near the closed end of the tube; and an orifice in the tube located between the closed end of the tube and the pair of rings, the orifice for directing a jet of gas radially away from the tube and toward the burner to ignite the burner; the device comprising:

a. a base mounted in fixed relation to the gas burner;

b. a rigid support plate attached to the base;

c. a rigid cover plate attached to the support plate, the cover plate extending over the pilot;

d. means for holding the pilot attached to the support plate.

7. The device of claim 6 wherein the means for holding the pilot comprises a bifurcated plate, the bifurcations formed to grip the pilot between the pair of rings on the pilot.

8. The device of claim 6 wherein the support plate additionally comprises a plate having a pair of tabs extending from the plate, the tabs formed to grip the pilot between the pair of rings on the pilot.

9. A stove for heating a vessel, the stove comprising:

a. means for supporting the vessel;

b. a gas burner for heating the vessel;

c. means for igniting gas supplied through the gas burner, the means for igniting further comprising a gas supply having an orifice; and d. means for holding the supply and for shielding the orifice, the means further comprising:

(1) a base;

(2) a cover attached rigidly to the base; and (3) positioning means coupled to the base for holding the supply in a position so that the cover shields the orifice and covers a region around the orifice, and for directing the flow of gas from the orifice.

10. The stove of claim 9 wherein the cover extends beyond the orifice for preventing material emitted from the vessel from entering the orifice.

11. The stove of claim 9 wherein the cover extends beyond the orifice for preventing material emitted from the vessel from burning so as to leave a deposit within the orifice.

12. The stove of claim 9 wherein the cover is between the orifice and an exhaust hood, the cover shielding the orifice from variations in air flow due to operation of the exhaust hood.

13. The stove of claim 9 wherein:

a. the supply further comprises a tube having an open end for gas to enter the tube, a closed end, and a pair of rings encircling the tube and attached to the tube near the closed end of the tube;

b. the orifice in the supply is an orifice in the tube located between the closed end and the pair of rings, the orifice for directing a jet of gas radially away from the tube and toward the burner to ignite the burner; and c. the positioning means further comprises a tab formed to grip the supply between the pair of rings.

14. The stove of claim 13 wherein the tab and the cover are formed as a unit.

15. The stove of claim 13 wherein the tab and the base are formed as a unit.

16. The stove of claim 13 wherein the tab is formed from a support separable from the cover.

17. The stove of claim 16 wherein the support is collectively mounted with the base.

18. A gas stove for heating a vessel, the stove comprising a gas burner, and means for igniting the burner comprising:

a. a gas supply having an orifice;

b. a shield;

c. a support coupled to the shield for holding the supply in one of a plurality of positions so that the shield shields the orifice, and for directing the flow of gas from the orifice toward the burner.

19. A method for preventing extinguishment of a gas igniter for a gas burner, the igniter comprising a pilot tube having an orifice, the method comprising the steps of:

a. holding the tube in fixed relation to the burner by coupling the tube to a means for holding the tube;

b. directing the flow of gas from the igniter by positioning the means for holding; and c. shielding the orifice with a cover connected to the means for holding.

20. The method of claim 19 further comprising the step of locating the cover between the orifice and an exhaust hood, the cover shielding the pilot from variations in air flow due to operation of the exhaust hood.

* * * * *